US005794936A

United States Patent [19]

Kakizaki

[11] Patent Number: 5,794,936

[45] Date of Patent: Aug. 18, 1998

[54] GAME APPARATUS

[75] Inventor: Katsumi Kakizaki, Tokyo, Japan

[73] Assignees: Toybox Corporation; Imagic, Inc., both of Tokyo, Japan

[21] Appl. No.: 905,965

[22] Filed: Aug. 5, 1997

[30] Foreign Application Priority Data

Aug. 27, 1996 [JP] Japan ..... 8-008639 U

[51] Int. Cl.[6] ..... A63F 9/14

[52] U.S. Cl. ..... 273/442

[58] Field of Search ..... 273/440, 441, 273/442

[56] References Cited

U.S. PATENT DOCUMENTS

| | | | |
|---|---|---|---|
| 4,270,306 | 6/1981 | Klawitter | 273/442 X |
| 4,761,006 | 8/1988 | Ledbetter | 273/442 |
| 5,265,889 | 11/1993 | Kojima | 273/442 |
| 5,346,398 | 9/1994 | Nakahata et al. | 273/442 X |

FOREIGN PATENT DOCUMENTS 2 252 919 8/1992 United Kingdom .

*Primary Examiner*—Raleigh W. Chiu

*Attorney, Agent, or Firm*—Oliff & Berridge, PLC

[57] ABSTRACT

A game apparatus in which the spiral spring is wound up by only operation of a handle or the like. The game apparatus comprises an operation member; a movement body for moving reciprocally in accordance with an operation of the operation member; a spiral spring used as a power source; a spiral spring winding-up mechanism for winding up the spiral spring by the operation of the operation member so as to store an energy in the spiral spring; a rotating member which has a display of a path for the movement body and is rotatable; and a power transmitting gear for transmitting the stored energy of the spiral spring to the rotating member to rotate; wherein one end of the spiral spring is engaged with a shaft of the spiral spring winding-up mechanism, which is rotated by the operation of the operation member, and the other end of the spiral spring is engaged with the power transmitting gear so as to enable rotation of the rotating member while the spiral spring is wound up.

7 Claims, 2 Drawing Sheets

GAME APPARATUS

BACKGROUND OF THE INVENTION

1. Field of the Invention

This invention relates to a game apparatus, e.g., a drive game apparatus in which a movement body such as an automobile model, an airplane model or the like, is operated by operation of a handle or the like, so as to trace a road or a course displayed on an endless film, a disc or the like which is rotatable.

2. Description of Related Art

A drive game apparatus using a spiral spring or a motor as a power source is hitherto broadly known. Such a drive game apparatus is constituted such that an endless film (a rotating member) or a disc (a rotating member) on which a road is displayed is rotated by a spiral spring or a motor and a movement body, such as an automobile model or the like, is operated by operation of a operation member, such as a handle or the like, so as to trace the road.

However, there were the problems in the above mentioned drive game apparatus, as follows.

That is, in the drive game apparatus which uses a spiral spring as a power source, first, the spiral spring is wound up by revolving a winding-up knob, and then the endless film or the disc is rotated by using an unwinding power (a stored energy) of a spiral spring. Once the spiral spring is wound up, it is only unwound until the stored energy is exhausted, and therefore it is difficult to continue a game by rewinding up the spiral spring in the middle of the game because the rotation of the endless film or the disc is stopped during rewinding up. On the other hand, a drive game which uses a motor as a power source is expensive because it requires a motor or batteries. Moreover, when the batteries are exhausted in the middle of the game, the game must be stopped for the exchange thereof and also the exchange of the batteries is difficult for a little child.

SUMMARY OF THE INVENTION

The present invention has been made in an attempt to solve the above-described problems of the conventional game apparatus. Therefore, an object of the invention is to provide a game apparatus which enables a game to be played continuously and is not expensive.

That is, in accordance with one aspect of the present invention, the game apparatus comprises an operation member; a movement body for moving reciprocally in accordance with an operation of the operation member; a spiral spring used as a power source; a spiral spring winding-up mechanism for winding up the spiral spring by the operation of the operation member so as to store an energy in the spiral spring; a rotating member which has a display of a path for the movement body and is rotatable; and a power transmitting gear for transmitting the stored energy of the spiral spring to the rotating member to rotate; wherein one end of the spiral spring is engaged with a shaft of the spiral spring winding-up mechanism, which is rotated by the operation of the operation member, and the other end of the spiral spring is engaged with the power transmitting gear so as to enable rotation of the rotating member while the spiral spring is wound up.

According to the game apparatus having such a construction, not only the spiral spring can be wound up by only operation of the operation member such as a handle, for moving the movement body, but also the rotating member having a display of a path for the movement body can be rotated while the spiral spring is wound up, so that a game can be played continuously. Furthermore, the game apparatus uses a spiral spring as a power source, so that the invention can realize a low-priced game apparatus.

Preferably, the operation member enables back and forth motions; and the spiral spring winding-up mechanism comprises a gear switching mechanism for enabling winding-up of the spiral spring by motion of the operation member in any case of the back and forth motions. According to the game apparatus having such a construction, the spiral spring can be wound up in any case of the back and forth movements of the operation member, so that the spiral spring can store power therein effectively.

The path for the movement body is preferably flexuous enough for the spiral spring to be wound up effectively while the path is traced by the movement body. Accordingly, because a player usually intends to try to shift the movement body along the path psychologically, the spiral spring can effectively store the power therein naturally by the operation of the operation member.

Preferably, the movement body is one selected from the group consisting of an automobile model, an airplane model, a ship model, a doll body, and an animal model. An input gear which is rotated by the operation of the operating member may be attached thereto, and the movement body comprises a rack engaged with the input gear to move the movement body reciprocally in accordance with an operation of the operation member. Preferably, an input gear which is rotated by the operation of the operating member is attached thereto; and the gear switching mechanism comprises first and second planet gears which are engaged with the input gear, the first planet gear being engaged with a gear for winding up the spiral spring when the input gear is rotated in a direction, the second planet gear being engaged with the gear for winding up the spiral spring through an intermediate gear when the input gear is rotated in the other direction. The first and second planet gears may be provided at separate two positions on a turning plate which is turned about a rotational axis of the input gear by rotation of the input gear.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

PREFERRED EMBODIMENT OF THE INVENTION

A preferred embodiment of the game apparatus in accordance with the present invention will be explained with reference to FIGS. 1 and 2.

Figure 1:
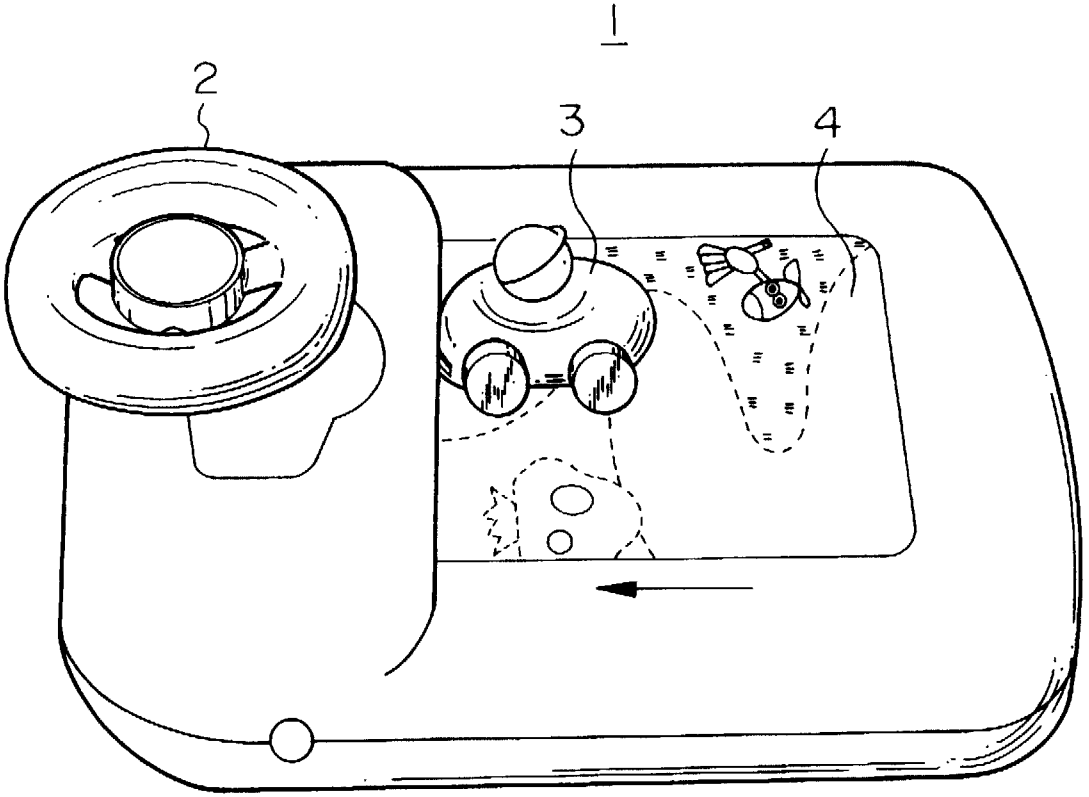
FIG. 1 is a perspective view of a game apparatus according to an embodiment of the invention.

FIG. 1 shows a game apparatus of this invention.

The game apparatus 1 is provided with a handle 2 (operation member) which can be turned around a rotary axis thereof in the clockwise direction or the counterclockwise direction, an automobile model 3 (movement body) which moves to the right or the left in accordance with an operation of the handle 2, i.e., to the clockwise direction or the counterclockwise direction, and an orbital film 4

(rotating member) having a display of a path for the automobile model 3 thereon, which is disposed under the automobile model 3 and is transferred to the handle side (to an arrow direction in FIG. 1) according to the operation of the handle 2. When the operation of the handle 2 is stopped in the middle of the operation, the orbital film 4 is transferred to the handle side by the unwinding power of a spiral spring 17 shown in FIG. 2, which have been stored therein, and then is stopped. In this way, a drive game can be enjoyed by only operating the handle 2 reciprocally in the clockwise or counterclockwise direction, in this game apparatus 1.

Figure 2:
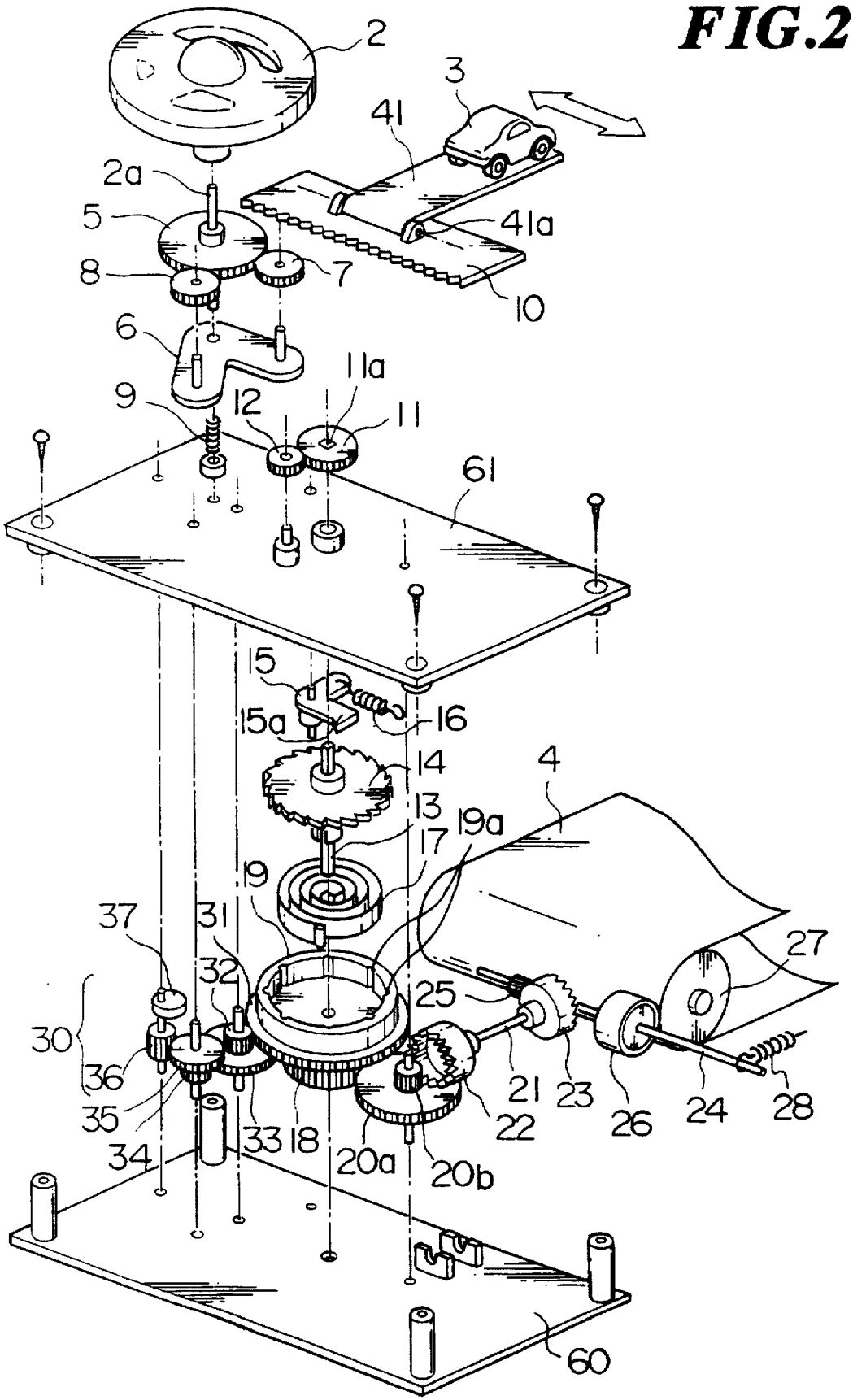
FIG. 2 is an exploded perspective view of the principal part in the game apparatus according to the embodiment.

In this game apparatus 1, an input gear 5 is attached to a rotation shaft 2*a* of the handle 2, as shown in FIG. 2. Under the input gear 5, a V-shaped turning plate 6 is also provided so as to turn around the shaft 2*a* of the input gear 5, and a first planet gear 7 and a second planet gear 8 are rotatably disposed at separate two positions on a turning plate. The planet gears 7 and 8 are always engaged with the input gear 5, and are made to be rotated around the input gear 5. The shaft 2*a* is loosely fitted in a through hole provided in the turning plate 6 and the turning plate 6 is biased upwardly so as to press against the lower surface of the input gear 5.

Further, a rack 10 is disposed so as to engage with the input gear 5 and can be moved to the right or the left by a turning of the input gear 5 in a clockwise direction or a counterclockwise direction. An operating plate 41 which can be turned around the shaft 41*a* up and down is attached to the upper surface of the rack 10, and an automobile model 3 is fixed to the operating plate 41.

Large and small intermediate gears 11 and 12 engaging with each other are disposed in the vicinity of the first and second planet gears 7 and 8. The intermediate gear 11 is disposed to engage with the first planet gear 7 and the other intermediate gear 12 is disposed to engage with the second planet gear 8.

A square hole 11*a* is formed in center of the intermediate gear 11, and a spiral spring winding-up shaft 13 having a square-shaped section is fitted into the square hole 11*a* of the intermediate gear 11.

A ratchet wheel 14 is attached in the middle of the spiral spring winding-up shaft 13. A pawl lever 15 is also engaged with the ratchet wheel 14. A pawl 15*a* of the pawl lever 15 is always pressed to teeth of the ratchet wheel 14 by the action of a spring 16 so as to prevent the ratchet wheel 14 from being backlashed.

An inner end of the spiral spring 17 is engaged with the lower end of the spiral spring winding-up shaft 13, and the other end of the spiral spring 17 is engaged with a spiral spring attachment part 19 which is integrally constituted of an output gear 18 which is a part of a power transmitting gear. The spiral spring attachment part 19 is cylinder-shaped, and a plurality of slots 19*a* extended in directions of the generating line are formed on the inside of the spiral spring attachment part 19, and an outer end of the spiral spring 17 is engaged with one of the slots 19*a*. After energy in the spiral spring 17 has been filled, when the spiral spring winding-up shaft 13 is further rotated, the whole spiral spring 17 is rotated so that the outer end of the spiral spring 17 is gone out of the present slot 19*a* on the inside of the spiral spring attachment part 19 and is slipped to go into the next slot 19*a*. Thereby, it is possible to prevent the spiral spring winding-up mechanism from destruction by over-winding.

A two-stage gear includes a larger gear 20*a* and a smaller gear 20*b* which are formed integrally. The larger gear 20*a* is engaged with the output gear 18. On the other hand, the smaller gear 20*b* is engaged with a crown gear 22 which is fixed to one end of a shaft 21. Another crown gear 23 is attached on the other end of the shaft 21 to which the crown gear 22 is fixed, and the crown gear 23 is geared with a pinion gear 25 which is fixed to a shaft 24. A drive roller 26 for driving the orbital film 4 is prepared on the shaft 24 to which the pinion gear 25 is fixed. The orbital film 4 is sandwiched and held between the drive roller 26 and a guide roller 27. The orbital film 4 is an endless one and is wound around the guide roller 27 and another guide roller which is not shown. A flexuous road for the automobile model 3 (path for the movement body) is displayed on the orbital film 4, as shown in FIG. 1. The road for the automobile model 3 is flexuous enough for the spiral spring 17 to be wound up effectively while the road is traced by the automobile model 3. A reference numeral 28 in FIG. 2 denotes a spring for biasing the drive roller 26 toward the a guide roller 27.

Furthermore, a speed governor mechanism 30 is provided in the output gear 18. The speed governor mechanism 30 is composed of gears 31–36 and an eccentric weight 37.

A reference numeral 60 in FIG. 2 denotes a base plate provided in the body and a reference numeral 61 denotes a middle plate.

Next, the operation of the inside mechanism of this game apparatus 1 will be explained, as follow.

When the handle 2 is operated to turn to the right (in a clockwise direction), the V-shaped turning plate 6 is turned in the clockwise direction by the moment of force which are given by the rotation of the input gear 5, so that the first planet gear 7 is engaged with the intermediate gear 11, and the gear 11 is made to turn in the clockwise direction. When the gear 11 is turned in the clockwise direction, the spiral spring 17 is wound up. On the one hand, the output gear 18 is turned by the stored power of the spiral spring 17, and the rotation power is transmitted to the drive roller 26 through gears 20*a*, 20*b*, 22, 23, and 25, resulting in the rotation of the orbital film 4.

On the one hand, when the handle 2 is operated to turn to the left (in a counterclockwise direction), the V-shaped turning plate 6 is turned in the counterclockwise direction by the moment of force which are given by the rotation of the input gear 5, so that the second planet gear 8 is engaged with the intermediate gear 12, and thereby the gear 11 is made to turn in the clockwise direction. When the gear 11 is turned in the clockwise direction, the spiral spring 17 is wound up. On the one hand, the output gear 18 is turned by the stored power of the spiral spring 17, and the rotation power is transmitted to the drive roller 26 through gears 20*a*, 20*b*, 22, 23, and 25, resulting in the rotation of the orbital film 4.

According to the game apparatus 1 of the embodiment, it is possible to obtain the following advantageous effects.

That is, not only the spiral spring 17 can be wound up by only operation of the handle for moving the automobile model 3, but also the orbital film 4 having a display of a road for the automobile model 3 can be rotated while the spiral spring 17 is wound up, so that a game can be played continuously. Furthermore, the game apparatus uses a spiral spring 17 as a power source, so that the invention can realize a low-priced game apparatus.

According to the game apparatus having such a construction, the spiral spring 17 can be wound up in any case of the clockwise and counterclockwise movements of the handle 2, so that the spiral spring 17 can store power therein effectively.

Further, the road for the automobile model 3 is preferably flexuous enough for the spiral spring to be wound up effectively while the road is traced by the automobile model 3. Accordingly, because a player usually intends to try to shift the automobile model 3 along the road psychologically, the spiral spring 17 can effectively store the power therein naturally by the operation of the automobile model 3.

Although the embodiments made by the inventor of the invention have been described, this invention should not be limited by any of the embodiments and various changes and modifications may be made in the invention without departing from the spirit and scope thereof.

For example, a game apparatus using an automobile model has been described in the foregoing embodiments, but the game apparatus may use an airplane model, a ship model, a doll body (for example, a skier model), or an animal model. In that case, it is desirable that the path is made to accommodate the form to a movement body. It is also desirable that the operation member is not a lever but is accommodated to the movement body.

As described above, according to the game apparatus of the invention, not only the spiral spring can be wound up by only operation of the operation member such as a handle, for moving the movement body, but also the rotating member having a display of a path for the movement body can be rotated while the spiral spring is wound up, so that a game can be played continuously. Furthermore, the game apparatus uses a spiral spring as a power source, so that the invention can realize a low-priced game apparatus.

What is claimed is:

1. A game apparatus comprising:

an operation member;

a movement body for moving reciprocally in accordance with an operation of the operation member;

a spiral spring used as a power source;

a spiral spring winding-up mechanism for winding up the spiral spring by the operation of the operation member so as to store an energy in the spiral spring;

a rotating member which has a display of a path for the movement body and is rotatable; and a power transmitting gear for transmitting the stored energy of the spiral spring to the rotating member to rotate;

wherein one end of the spiral spring is engaged with a shaft of the spiral spring winding-up mechanism, which is rotated by the operation of the operation member, and the other end of the spiral spring is engaged with the power transmitting gear so as to enable rotation of the rotating member while the spiral spring is wound up.

2. The game apparatus as claimed in claim 1;

wherein the operation member enables back and forth motions; and the spiral spring winding-up mechanism comprises a gear switching mechanism for enabling winding-up of the spiral spring by motion of the operation member in any case of the back and forth motions.

3. The game apparatus as claimed in claim 1;

wherein the path for the movement body is flexuous enough for the spiral spring to be wound up effectively while the path is traced by the movement body.

4. The game apparatus as claimed in claim 1;

wherein the movement body is one selected from the group consisting of an automobile model, an airplane model, a ship model, a doll body, and an animal model.

5. The game apparatus as claimed in claim 1;

wherein an input gear which is rotated by the operation of the operating member is attached thereto, and the movement body comprises a rack engaged with the input gear to move the movement body reciprocally in accordance with an operation of the operation member.

6. The game apparatus as claimed in claim 2:

wherein an input gear which is rotated by the operation of the operating member is attached thereto; and the gear switching mechanism comprises first and second planet gears which are engaged with the input gear, the first planet gear being engaged with a gear for winding up the spiral spring when the input gear is rotated in a direction, the second planet gear being engaged with the gear for winding up the spiral spring through an intermediate gear when the input gear is rotated in the other direction.

7. The game apparatus as claimed in claim 6;

wherein the first and second planet gears are provided at separate two positions on a turning plate which is turned about a rotational axis of the input gear by rotation of the input gear.

* * * * *